US006166696A

United States Patent [19]

Chenoweth et al.

[11] Patent Number: 6,166,696

[45] Date of Patent: Dec. 26, 2000

[54] DUAL RADIATOR GALVANIC CONTACT ANTENNA FOR PORTABLE COMMUNICATOR

[75] Inventors: John Chenoweth, Mundelein; Fazil Ahmed, Hanover Park, both of Ill.

[73] Assignee: T&M Antennas, Vernon Hills, Ill.

[21] Appl. No.: 09/201,628

[22] Filed: Nov. 30, 1998

[51] Int. Cl.[7] ..... H01Q 1/24

[52] U.S. Cl. ..... 343/702; 343/895; 343/901

[58] Field of Search ..... 343/702, 900, 343/901, 715, 895

[56] References Cited

U.S. PATENT DOCUMENTS

| | | | |
|---|---|---|---|
| 3,737,910 | 6/1973 | Francis et al. | 343/895 |
| 4,658,260 | 4/1987 | Myer | 343/792 |
| 4,675,687 | 6/1987 | Elliott | 343/715 |
| 4,725,846 | 2/1988 | Hendershot | 343/792 |
| 4,847,629 | 7/1989 | Shimazaki | 343/901 |
| 5,079,562 | 1/1992 | Yarsunas et al. | 343/792 |
| 5,177,492 | 1/1993 | Tomura | 343/702 |
| 5,204,687 | 4/1993 | Elliott et al. | 343/702 |
| 5,243,355 | 9/1993 | Emmert et al. | 343/702 |
| 5,245,350 | 9/1993 | Sroka | 343/702 |
| 5,353,036 | 10/1994 | Baldry | 343/702 |
| 5,521,605 | 5/1996 | Koike | 343/702 |
| 5,594,457 | 1/1997 | Wingo | 343/702 |
| 5,600,341 | 2/1997 | Thill et al. | 343/895 |
| 5,606,327 | 2/1997 | Elliott et al. | 343/702 |
| 5,661,496 | 8/1997 | Baek et al. | 343/702 |
| 5,699,070 | 12/1997 | Mischenko et al. | 343/702 |
| 5,734,352 | 3/1998 | Seward et al. | 343/722 |
| 5,836,005 | 11/1998 | Chang | 343/702 |
| 5,880,696 | 3/1999 | Koleda | 343/702 |

*Primary Examiner*—Don Wong
*Assistant Examiner*—Tan Ho
*Attorney, Agent, or Firm*—Greer, Burns & Crain, Ltd.

[57] ABSTRACT

A dual radiator galvanically coupled antenna for a portable communication device. The antenna includes separate elongate and upper radiators that respectively galvanically couple to phone circuits in extended and retracted states. An insulator, preferably thermoplastic, mechanically connects and electrically separates the elongate and upper radiators. In a preferred embodiment, a shaped conductor provides an electrode with a cup having a thinned wall which crimps onto an end of an upper helical radiator to make electrical contact thereto. The shaped conductor also forms an exposed galvanic electrical contact, and an enlarged knurled portion for mechanical connection to the insulator. A separate enlarged galvanic contact is formed at a terminal end of the elongate conductor. An additional preferred embodiment includes an upper rod galvanically coupled to the electrode and electrically parallel with the helical radiator.

6 Claims, 2 Drawing Sheets

DUAL RADIATOR GALVANIC CONTACT ANTENNA FOR PORTABLE COMMUNICATOR

FIELD OF THE INVENTION

The present invention generally concerns antennas for a portable communicator. More specifically, the present invention concerns antennas which are operable in separate retracted and extended positions.

BACKGROUND OF THE INVENTION

Portable communicators, particularly cell phones, sometimes use multiple radiators so that one radiator is active in a retracted position and the other is active in an extended position. Retraction of the antenna allows a user of the phone to store it in purses, briefcases, and more recently, even in shirt pockets. Having an active antenna in the retracted position permits use of the phone, such as stand-by operation, with the antenna in the retracted position. In areas where reception is poor, the antenna might be extended to avoid interference, for example, resulting from the head of a human user. The blocking effect of a human head can adversely affect the low power signal between a base station and a cell phone, thereby reducing the quality of communications.

An additional use of separate radiators in an antenna is to enable phones to receive two different types of signals. These phones are compatible then with multiple cellular networks. Thus, for example, an antenna might act as a half-wave radiator in an extended position, and as a quarter wave radiator in a retracted position. Conventional solutions to providing such radiator antennas frequently utilize a capacitive coupling. These provide lower quality than galvanic couplings. In addition, a complicated switching arrangement is often required to disable the capacitive coupling.

An additional problem concerns antennas having an exposed electrical contact at an end for contact to phone circuits. As the antenna is retracted or extended, the electrical contact sometimes catches or contacts circuits or phone portions in an unintended and undesirable manner.

In sum, a dual radiator antenna should provide efficient operation in its separate retracted and extended positions and should avoid complicated structures and switching requirements. In addition to these specific desirable qualities, the performance of the antenna should be robust and should not significantly degrade from a small number of cycles of retraction and extension during use. There is therefore a need for an improved antenna which exhibits such qualities.

SUMMARY OF THE INVENTION

Such needs are met or exceeded by the present dual radiator antenna. The present antenna obtains galvanic coupling to circuits of a portable communicator, such as a cell phone, with one radiator in a retracted position and with a separate radiator in an extended position. A preferred embodiment of the present antenna includes a contact at the end of an elongate radiator which is protected from unintended contact with phone parts during retraction and extension by a nonconductive guide sleeve. An insulator also separates the dual radiators of the antenna to prevent electrical contact therebetween.

More specifically, the preferred embodiment of the present antenna includes an elongate radiator that is coated with a protective material. The elongate radiator is, for example, a quarter wave radiator. An enlarged galvanic contact is formed at an end of the elongate radiator and its other end terminates in a connection to an electrical insulator, preferably thermoplastic material molded over its end. A length of the insulator separates the elongate radiator from a shaped conductor that is mechanically connected to the elongate radiator through the insulator. A portion of the shaped conductor is exposed from the insulator to form an upper electrical contact to phone circuits for a separate upper helical radiator galvanically attached to an electrode formed at an end of the shaped conductor. The electrode includes a cup having a thinned wall which crimps onto an end of the helical conductor. A conductive ferrule serves to mechanically connect the antenna to a portable communicator, and also serves as a galvanic coupling point for the separate radiators of the antenna. The upper helical radiator is galvanically coupled to the ferrule through the shaped conductor when the antenna is in a retracted position. The elongate conductor is galvanically coupled to the ferrule through the enlarged contact when the antenna is in an extended position. An additional preferred feature is an upper rod radiator coupled to the electrode and electrically in parallel to the upper helical radiator.

BRIEF DESCRIPTION OF THE DRAWINGS

Other features and advantages of the invention will be apparent to those skilled in the art with reference to the detailed description and the drawings, of which.

DETAILED DESCRIPTION OF THE INVENTION

Figure 1:
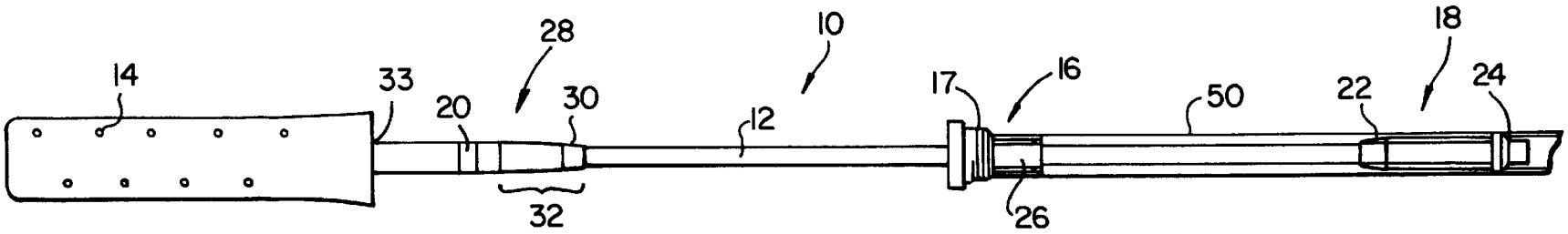
FIG. 1 is a partial side view of a fully assembled antenna constructed according to the present invention.
Figure 3:
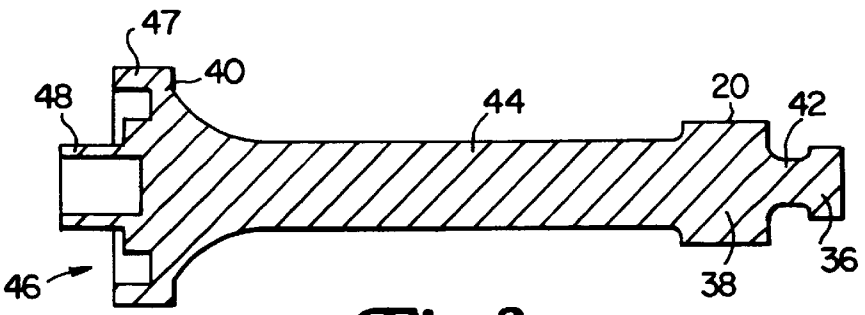
FIG. 3 is a cross sectional view of a shaped contact from FIG. 1.
Figure 2:
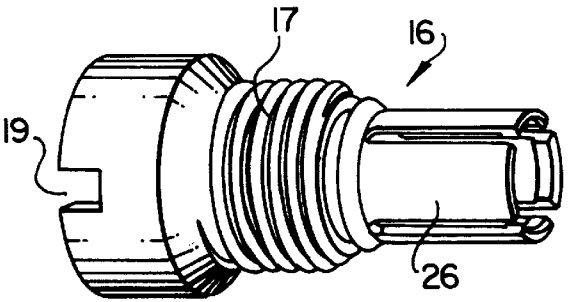
FIG. 2 is a perspective view of the preferred conductive ferrule shown in FIG. 1.

According to the present invention, a first preferred embodiment of which is shown in FIGS. 1–3, an antenna 10 is constructed primarily from a protectively coated thin, flexible elongate radiator 12 and a protectively coated upper radiator 14. Both radiators are protected by an insulator in a conventional manner. The antenna 10 makes galvanic contact with phone circuits via the elongate radiator 12 when in an extended position and via the upper radiator 14 when in a retracted position. Preferably, the elongate radiator 12 is a quarter wave whip radiator, while the helical radiator 14 is a quarter wave helical radiator. The invention is applicable to single band antennas as well as multi band antennas. Thus, an antenna of the invention might operate in a single band in both its extended and retracted positions, in separate bands in its extended and retracted positions, or in multiple bands in each of its extended and retracted positions.

To use the illustrated embodiment, a cell phone or other device should include means to galvanically couple to a conductive ferrule 16, preferably through threads 17 on the ferrule to also form a mechanical mounting connection. Artisans will appreciate that the mechanical mounting may be modified, and that a galvanic contact formed in the phone separately from the preferred ferrule 16 may also be used, so long as the separate contact is able to contact a lower galvanic contact 18 when the antenna 10 is in an extended position and an upper galvanic contact 20 when the antenna 10 is in a retracted position.

The lower contact 18 is preferably an enlarged contact having a tapered portion 22 and a stop 24 and attached to an end of the elongate conductor, which is exposed from its protective insulator. Crimping is an exemplary form of suitable connection. The tapered portion 22 serves to assist passage of the lower galvanic contact 18 into the conductive ferrule 16. The preferred ferrule 16 also serves to assist this passage, as it has legs 26 which will expand under influence of the lower galvanic contact 18 when it enters as the antenna 10 is extended and exert a spring force to form a reliable galvanic connection. The ends of the legs 26 are preferably tapered or rounded to encourage smooth entry of the contact 18 beginning with its tapered portion 22, as best seen in the perspective view of FIG. 2. A slot 19 assists in attaching the ferrule 16 to a phone or other portable communicator.

The expansion of the legs 26 may alternately serve to establish a similar electrical contact with a contact of a cell phone into which the antenna 10 is inserted. In that case, only the legs 26 need to be conductive to achieve the desired galvanic contact, but it is preferred and convenient to form the entire ferrule 16 from conductive material so electrical contact may be made through its threads or another portion. The stop 24 is wide enough to stop further extension of the antenna 10 when it comes into contact with the legs 26. The spring force exerted by the legs 26 will also serve to hold the antenna 10 in an extended position, while allowing retraction under influence of a force exerted by a user of a cell phone or other communicator into which the antenna 10 is attached. The galvanic contact between the lower contact 18, the legs 26, the ferrule 16 and an associated contact of a communicator in which the antenna 10 is being used completes a galvanic coupling between the elongate radiator 12 and appropriate circuits of the communicator.

The legs 26 of the ferrule 16 also will expand to accept entry of antenna section 28 as the antenna 10 is retracted through the ferrule 16, to achieve a separate galvanic coupling to the helical radiator 14. The section 28 includes a tapered portion 30 to encourage smooth passage of the section 28. The tapered portion 30 is formed from thermoplastic or another suitable electrical insulator. This insulator 32 extends to the upper galvanic contact 20, to provide electrical isolation between the elongate radiator 12 and the upper galvanic contact 20 while holding the elongate radiator 12 and the upper galvanic contact 20 apart from each other, to also providing mechanical connection between those components.

In a fully retracted position, the upper galvanic contact 20 will be galvanically coupled with the legs 26 as ends of the legs exert spring force on the upper galvanic contact 20. The length between the upper galvanic contact 20 and a base of protective coating 33 around the helical conductor 14 is such that when the protective coating 33 abuts the ferrule 16, the upper galvanic contact 20 is aligned with ends of the legs 26. Because the insulator 32 isolates the upper galvanic contact 20 from the elongate radiator 12, only the helical radiator 14 is galvanically coupled to the legs 26 in the retracted position.

The upper galvanic contact 20 is preferably an exposed portion of a shaped conductor 34, as seen in FIG. 3. The-upper galvanic contact 20 is one of three wide portions 36, 38 and 40 which are separated by narrow portions 42 and 44. The smallest wide portion 36 is preferably knurled. Insulator 32, for example thermoplastic, completely surrounds the narrow portion 42 and smallest wide portion 36 to form mechanical connection between the shaped conductor 34 and the elongate radiator 12. The insulator 32 may be applied to be of equal outside diameter to the wide portion 38, thereby leaving the upper galvanic contact 20 exposed and providing a smooth surface over which the legs 26 may pass. The knurled wide portion 36 will inhibit relative rotation between the shaped conductor 34 and the insulator 32. Thermoplastic or another suitable insulator also extends, preferably in equal diameter to the wide portion 38, from the wide portion 38 to completely cover the narrow portion 44, before widening to cover and protectively coat the wide portion 40 and the helical conductor 14.

Electrical and mechanical connection between the helical conductor 14 and the shaped conductor 34 is made via an electrode cup 46. An end of the helical conductor 14 lies in the cup 46 and is crimped thereto. For example, a thinned section 47 of the wide portion 40 may be crimped to the helical conductor. A central extension 48 provides a base to align the helical conductor.

Referring again to FIG. 1, the antenna 10 also preferably includes a protective sleeve 50. The sleeve 50 is an insulator, such as plastic, and has an inside diameter sufficient to permit sliding passage of the stop 24 and to permit the sleeve 50 to surround the legs 26 of the ferrule 16. The sleeve 50 is preferably of sufficient length to enclose the lower galvanic contact 18 when the antenna is in a fully retracted position. The sleeve 50 serves to guide the contact 18 through its range of motion and prevent undesired contact with phone components other than the legs 26. Use of the invention with the sleeve 50 requires more than the legs 26 of the ferrule 16 to be conductive because the sleeve will prevent electrical contact of the legs 26 with a contact within the phone circuit. The threads 17 of the ferrule 16 provide the preferred and convenient point for electrical connection with a phone contact.

Figure 4:
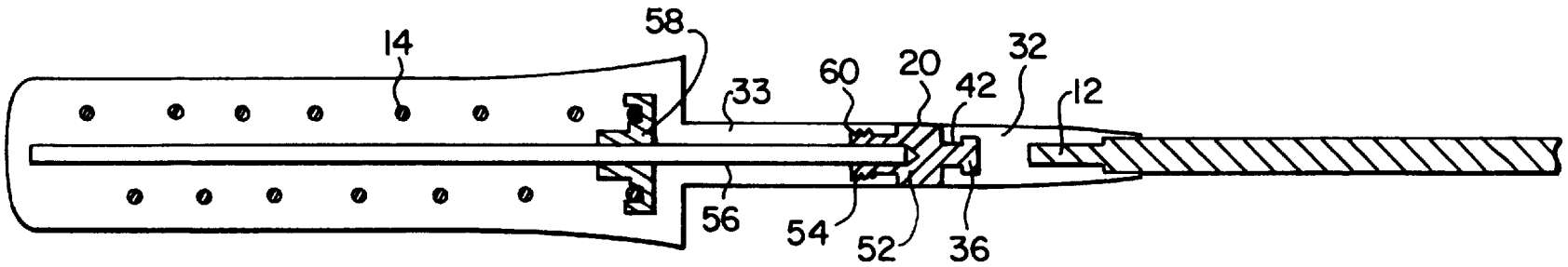
FIG. 4 is a partial cross section of an alternate embodiment of the antenna according to the present invention.

An alternate embodiment of the antenna 10 is illustrated in FIG. 4. This embodiment has an alternate shaped conductor 52 which includes a slot 54 that crimps onto a rod radiator 56 to eventually galvanically couple to an electrode 58 and the helical radiator 14. Threads 60 around the slot 54 provide good mechanical connection to surrounding insulator 33. This embodiment makes galvanic contact in the same manner as the FIG. 1 embodiment since the upper contact will galvanically contact legs 26 in a retracted position, the elongate radiator 12 is electrically isolated from the shaped conductor 54, and the lower contact 18 will galvanically couple with the legs 26 in an extended position. Artisans will appreciate, though, that the rod radiator 56 and helical radiation 14 are in parallel. This is especially suitable for dual band operation of the antenna 10 when in its retracted position. Dual band operation may also be obtained in the extended position through the single elongate radiator 12. Additional parallel radiator modifications might include a larger diameter helical radiator around a smaller one, or two or more concentric helical radiators having like diameter and pitch wound around a plastic core.

Other alterations and modifications will be apparent to those skilled in the art. Accordingly, the scope of the invention is not limited to the specific embodiments used to illustrate the principles of the invention. Instead, the scope of the invention is properly determined by reference to the appended claims and any legal equivalents thereof.

What is claimed is:

1. A retractable antenna for a portable communicator, the antenna comprising:

an elongate radiator;

a protective coating on said elongate radiator;

a lower galvanic electrical contact galvanically coupled to one end of said elongate radiator;

an insulator connected to an opposite end of said elongate radiator;

a shaped conductor mechanically connected to and electrically isolated from said elongate radiator via said insulator, a contact portion of said shaped conductor being exposed to form an upper galvanic electrical contact; and an upper helical radiator galvanically coupled to said shaped conductor, wherein an upper portion of said shaped conductor forms an electrode cup for accepting an end of said helical radiator, and wherein said shad conductor comprises a generally elongate cylinder with two narrow portions separating three wide portions.

2. The antenna according to claim 1, wherein a middle one of said wide portions comprises said contact portion.

3. The antenna according to claim 1, wherein an end one of said wide portions is knurled and said insulator connects around said end one.

4. The antenna according to claims 3, further comprising insulator around said two narrow portions, a second end one of said wide portions, and said helical radiator.

5. A retractable antenna for a portable communicator, the antenna comprising:

an elongate radiator;

a protective coating on said elongate radiator;

a lower galvanic electrical contact galvanically coupled to one end of said elongate radiator;

an insulator connected to an opposite end of said elongate radiator;

a shaped conduct mechanically connected to and electrically isolated from said elongate radiator via said insulator, a contact portion of said shaped conductor being exposed to form an upper galvanic electrical contact; and an upper helical radiator galvanically coupled to said shaped conductor, wherein an upper portion of said shaped conductor forms an electrode cup for accepting an end of said helical radiator; and a rod radiator galvanically coupled to said helical radiator and said electrode cup, said rod radiator being in parallel with said helical radiator.

6. A retractable antenna for a portable communicator, the antenna comprising:

an elongate radiator;

a protective coating on said elongate radiator;

a lower galvanic electrical contact galvanically coupled to one end of said elongate radiator;

an insulator connected to an opposite end of said elongate radiator;

a shaped conductor mechanically connected to and electrically isolated from said elongate radiator via said insulator, a contact portion of said shaped conductor being exposed to form an upper galvanic electrical contact;

an upper helical radiator galvanically coupled to said shaped conductor; and an upper parallel radiator galvanically coupled to said upper helical radiator and said shaped conductor and being electrically in parallel with said upper helical radiator.

* * * * *